US008767972B2

(12) United States Patent
Hou

(10) Patent No.: US 8,767,972 B2
(45) Date of Patent: Jul. 1, 2014

(54) AUTO-FIT HEARING AID AND FITTING PROCESS THEREFOR

(75) Inventor: Zezhang Hou, Cupertino, CA (US)

(73) Assignee: Apherma, LLC, St. Paul, MN (US)

( * ) Notice: Subject to any disclaimer, the term of this patent is extended or adjusted under 35 U.S.C. 154(b) by 1262 days.

(21) Appl. No.: 11/839,482

(22) Filed: Aug. 15, 2007

(65) Prior Publication Data

US 2008/0044034 A1 Feb. 21, 2008

Related U.S. Application Data

(60) Provisional application No. 60/837,797, filed on Aug. 16, 2006.

(51) Int. Cl.
*H04R 29/00* (2006.01)
*H04R 25/00* (2006.01)

(52) U.S. Cl.
USPC ..... 381/60; 381/312; 381/317; 381/318

(58) Field of Classification Search
USPC ..... 381/60, 312–331, 71.1, 93, 98, 101, 381/102, 104, 107, 108
See application file for complete search history.

(56) References Cited

U.S. PATENT DOCUMENTS

| | | | | |
|---|---|---|---|---|
| 4,596,902 | A * | 6/1986 | Gilman | 381/320 |
| 5,553,152 | A * | 9/1996 | Newton | 381/328 |
| 6,044,162 | A * | 3/2000 | Mead et al. | 381/312 |
| 6,072,884 | A * | 6/2000 | Kates | 381/318 |
| 6,611,600 | B1 * | 8/2003 | Leber et al. | 381/66 |
| 2007/0076909 | A1 * | 4/2007 | Roeck et al. | 381/312 |

* cited by examiner

*Primary Examiner* — Matthew Eason
(74) *Attorney, Agent, or Firm* — Locke Lord LLP

(57) ABSTRACT

Improved approaches of designing and fitting hearing aids to make hearing aids more accessible to people with hearing loss are disclosed. The hearing aids can be capable of being fitted by users themselves or by other non-hearing specialists. In one embodiment a hearing aid can be self-calibrating. In another embodiment, hearing aids can be fitted, i.e., configured, for individuals with hearing loss using a simplified procedure that hearing aid users or non-hearing specialists can easily follow.

6 Claims, 4 Drawing Sheets

AUTO-FIT HEARING AID AND FITTING PROCESS THEREFOR

CROSS-REFERENCE TO OTHER APPLICATION

This application claims the benefit of U.S. Provisional Application No. 60/837,797, filed Aug. 16, 2006, and entitled "Hearing Aid with in-situ ear environment calibration", the contents of which is hereby incorporated by reference.

BACKGROUND OF THE INVENTION

A hearing aid operates to amplify sounds for users that are hearing impaired. However, when the gain amplification is greater than the attenuation of feedback sound from receiver to microphone, the hearing aid becomes unstable and can produce unwanted whistling sound. Conventionally, echo cancellation techniques have been used to increase the useable gain before the hearing aid starts to produce the unwanted whistling sound. The amount of the increase in useable gain yielded by echo cancellation, referred to as headroom improvement, depends on the merit of the underlining echo cancellation algorithm, which largely depends on how accurate the echo cancellation processing models the characteristics of the feedback path.

Existing hearing aids that provide good headroom improvement rely on an off-line calibration of the feedback path to produce a relatively accurate model of the feedback path. The off-line calibration requires the hearing aid to be connected to special equipment or a computer, usually installed in the office of hearing aid professional (e.g., audiologist). Unfortunately, with hearing aids, the feedback path can change at a result of change in-ear acoustics (e.g., ear canal size, wax condition, head wears (e.g., hat or scarf), etc.). In such cases, for accurate operation, the user must go back to the hearing aid professional's office to get the hearing aid recalibrated.

Existing hearing aids also require comprehensive adjustments by experienced hearing aid professionals to meet patients' individual hearing needs because each patient may have a unique hearing loss. When experienced professionals are not readily available, it is difficult and/or inconvenient for users to have their hearing aids fitted. The self-adjustment or adjustments by less experienced professionals demand the adjustment system to be extremely simple yet can result in accurate results.

Thus, there is a need for a hearing aid that can characterize the feedback path and cancel feedback echoes all by itself, and a need for a simple yet accurate fitting procedure and system to adjust the hearing aid parameters.

SUMMARY OF THE INVENTION

The invention relates to improved approaches of designing and fitting hearing aids to make hearing aids more accessible to people with hearing loss. The hearing aids can be capable of being fitted by users themselves or by other non-hearing specialists.

According to one aspect of the invention, a hearing aid can be self-calibrating. In this aspect, a hearing aid is able to accurately characterize acoustic properties of an ear environment and produce a signal processing model of its acoustic feedback path from receiver to microphone. As a result, the hearing aid can effectively cancel the feedback echo and produce large headroom improvement without being connected to a computer and without involving an experienced professional.

Another aspect of the invention pertains to a method of fitting hearing aids, i.e., the configuration of hearing aids for individuals with hearing loss. In this aspect, hearing aid users themselves or non-hearing specialists can easily following a fitting process to fit hearing aids to users.

The invention can be implemented in numerous ways, including as a method, system, device, apparatus, or computer readable medium. Several embodiments of the invention are discussed below.

As a digital hearing aid, one embodiment includes at least: a microphone for picking up sound and producing analog sound signals; an analog-to-digital converter configured to convert the analog sound signals to digital sound signals; a processing unit including amplification logic and calibration logic, the calibration logic being configured to produce feedback calibration stimuli and determine feedback cancellation parameters, and the amplification logic being configured to process the digital sound signals in accordance with configuration parameters, the configuration parameters including at least frequency gain parameters and the feedback cancellation parameters, the processing unit operating in an amplification mode or a calibration mode; mode control logic configured to set the digital hearing aid to the calibration mode after the said digital hearing aid is turned on, and the mode control logic being configured to set the digital hearing aid to the amplification mode after the calibration is completed; a data storage device storing the configuration parameters; a digital-to-analog converter configured to convert the processed digital sound signals to processed analog sound signals; and an audio output device capable of outputting sound in accordance with the processed analog sound signals.

As a digital hearing aid, another embodiment includes at least: a microphone for picking up sound and producing analog sound signals; an analog-to-digital converter configured to convert the analog sound signals to digital sound signals; a processing unit including amplification logic and calibration logic, the calibration logic being configured to determine feedback calibration parameters, and the amplification logic being configured to process the digital sound signals in accordance with configuration parameters, the configuration parameters including at least amplification calibration parameters and the feedback calibration parameters; a data storage device storing the configuration parameters; a digital-to-analog converter configured to convert the processed digital sound signals to processed analog sound signals; and an audio output device capable of outputting sound in accordance with the processed analog sound signals.

As an automated fitting procedure for a hearing aid device, one embodiment of the invention includes at least: providing initial setup for the hearing aid device; the initial setup includes at least calculating initial settings from hearing loss data, performing an ear environment calibration, or playing sound samples in background; searching for optimized volume settings using large step sizes; searching for optimized volume settings using small step sizes; searching for optimized equalization settings using large step sizes; searching for optimized equalization settings using small step sizes; and programming the hearing aid device in accordance with the optimized volume settings and the optimized equalization settings.

As an automated fitting procedure for a hearing aid device, one embodiment of the invention includes at least: providing initial setup for the hearing aid device; searching for optimized volume settings; searching for optimized equalization settings; and programming the hearing aid device in accordance with the optimized volume settings and the optimized equalization settings.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to improved approaches of designing and fitting hearing aids to make hearing aids more accessible to people with hearing loss. The hearing aids can be capable of being fitted by users themselves or by other non-hearing specialists.

According to one aspect of the invention, a hearing aid can be self-calibrating. In this aspect, a hearing aid is able to accurately characterize acoustic properties of an ear environment and produce a signal processing model of its acoustic feedback path from receiver to microphone. As a result, the hearing aid can effectively cancel the feedback echo and produce large headroom improvement without being connected to a computer and without involving an experienced professional.

Another aspect of the invention pertains to a method of fitting hearing aids, i.e., the configuration of hearing aids for individuals with hearing loss. In this aspect, hearing aid users themselves or non-hearing specialists can easily following a fitting process to fit hearing aids to users.

Figure 1:
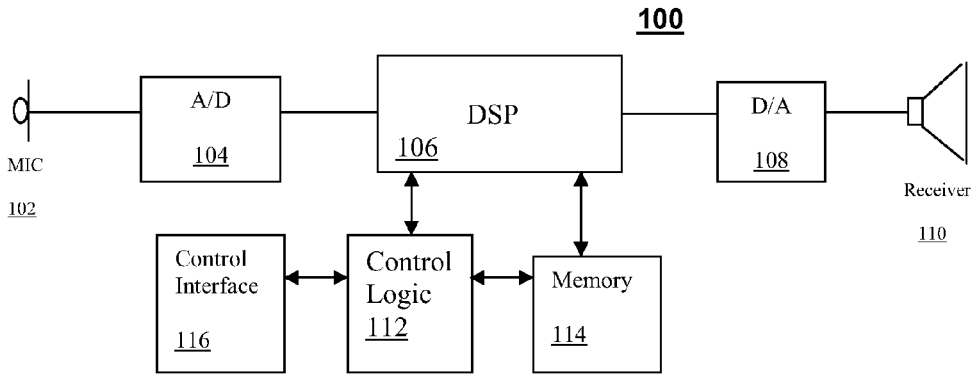
FIG. 1 is a schematic of a conventional digital hearing aid system.

FIG. 1 is a schematic of a conventional digital hearing aid system 100. The conventional digital hearing aid system 100 includes a microphone (MIC) 102 that picks up sound and converts it into electronic analog signals. An analog-to-digital (A/D) converter 104 converts the analog signals from the microphone 102 into digital signals. A digital signal processor (DSP) 106 operates to process the digital signals from the A/D converter 104. More particularly, the DSP 106 includes amplification circuitry and/or software processes that filter the digital signals to reduce unwanted components and also amplify desired components to compensate for hearing loss. A digital-to-analog (D/A) converter 108 can then converts the processed digital signals back to processed analog signals. Finally, the processed analog signals can be supplied to a receiver 110 to output amplified sounds. The DSP 106 operates in accordance with control logic 112 and parameters. The parameters can be stored in a memory 114. The parameters utilized by the DSP 106 can be set manually or by another device via a control interface 116.

With a conventional digital hearing aid, such as the digital hearing aid 100 illustrated in FIG. 1, a hearing aid professional is required to initially set up the device for a particular user (patient). However, over time the amplification circuits within the DSP 106 can become less stable. In such cases, the functioning of the digital hearing aid degrades and users (patients) are conventionally required to re-visit a hearing aid professional to get their digital hearing aids fixed or recalibrated.

Embodiments of the invention are discussed below with reference to FIGS. 1-6. However, those skilled in the art will readily appreciate that the detailed description given herein with respect to these figures is for explanatory purposes as the invention extends beyond these limited embodiments.

Figure 2:
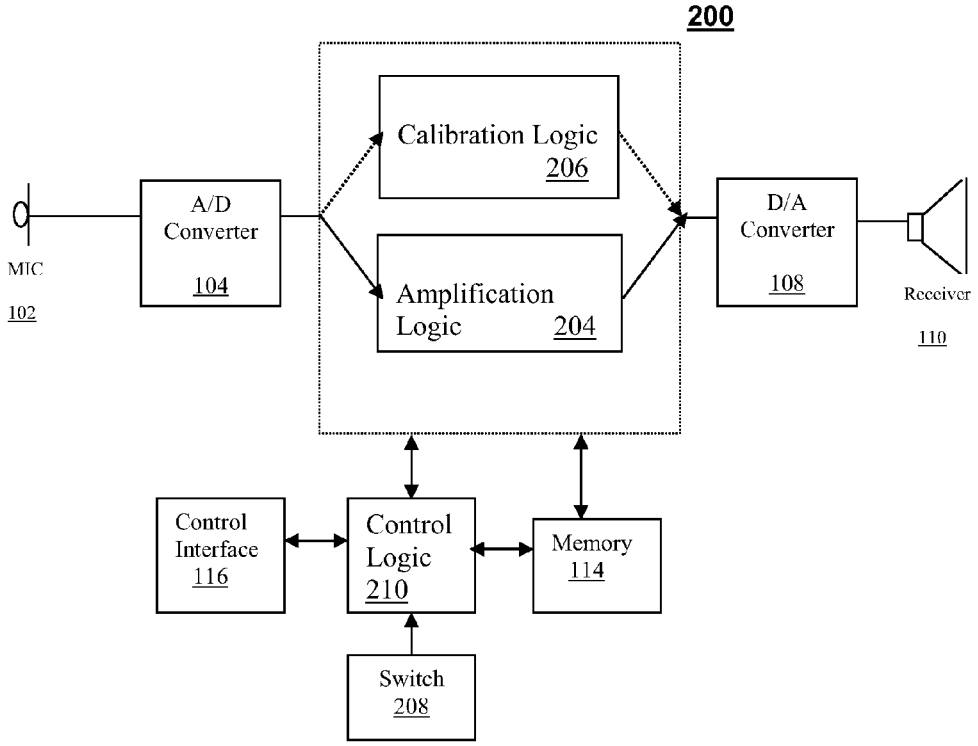
FIG. 2 is a schematic of a digital hearing aid system according to one embodiment of the invention.

FIG. 2 is a schematic of a digital hearing aid system 200 according to one embodiment of the invention. The digital hearing aid system 200 is generally similar to the digital hearing aid system 100 illustrated in FIG. 1. Namely, like the digital hearing aid 100 illustrated in FIG. 1, the digital hearing aid system 200 can include the microphone 102, the A/D converter 104, the D/A converter 108, the receiver 110, the memory 114 and the control interface 116. However, the digital hearing aid system 200 includes a digital signal processor 202 that includes at least amplification logic 204 and calibration logic 206. The amplification logic 204 can operate to filter the digital signals to reduce unwanted components and then amplify desired components to compensate for hearing loss. The calibration logic 206 can operates to calibrate the operation of the DSP 200. For example, if calibration or re-calibration of the digital hearing aid system 200 is requested, the digital hearing aid system 200 can be operates such that the digital hearing aid system 200 calibrates itself.

In one embodiment, the calibration being performed is an ear environment calibration. Accordingly, the digital hearing aid system 200 illustrated in FIG. 2 can perform calibration, e.g., ear environment calibration, by itself. Hence, the digital hearing aid system 200 can be self-calibrating without the needed for external calibration devices (e.g., computer operating calibration software) and without the need for assistance from hearing aid professionals. As a result, if the digital hearing aid system 200 were to become unstable after its initial setup, the digital hearing aid system 200 can recalibrate itself to return to stable operation.

The digital hearing aid system 200 can also include a switch 208. The switch 208 can be used to initiate a calibration (e.g., recalibration). In one embodiment, the digital hearing aid system 200 can operate in a normal amplification mode or a calibration mode. The DSP 202 operates differently in the different modes. In the normal amplification mode, the DSP 202 can perform filtering and amplification operations. In the calibration mode, the DSP 202 can perform calibration operations and updated parameters can be saved in the memory 114.

Normally, the DSP 200 operates in the normal amplification mode so that input sound is processed to compensate for hearing loss. When a need for calibration (i.e., ear environment calibration) is indicated, the calibration mode can be selected by an action from the switch 208. In the digital hearing aid system 200, the switch 208 provides a signal to control logic 210 which controls the mode of operation for the DSP 202. For example, when the digital hearing aid system 200 undesirably produces a whistling sound while in the normal amplification mode, then the calibration mode can be selected by an action via the switch 208.

Mode selection, such as by the switch 208 or otherwise, can be activated automatically, by user action or by another device. In one embodiment, the control logic 210 operates to provide mode selection for the DSP 202. The control logic 210 provides mode control as well as other conventional logic such as provided by the control logic 112 illustrated in FIG. 1.

As one example, the control logic 210 can activate the calibration mode when the digital hearing aid system 200 is turned on and then de-activate the calibration mode after the calibration procedure is completed. As another example, the control logic 210 can activate the calibration mode when a user applies an action to the switch 208 on the digital hearing aid device system 200 and then de-activate the calibration mode after the calibration procedure is completed. As yet another example, the control logic 210 can receive a signal from an external device (e.g., a computer) via the control interface 116 which can cause activation of the calibration mode. More generally, the external device can interact with the digital hearing aid system 220 via the control interface 116 to transmit data between the digital hearing aid system 200 (e.g., the memory 114) and the external device.

Figure 3:
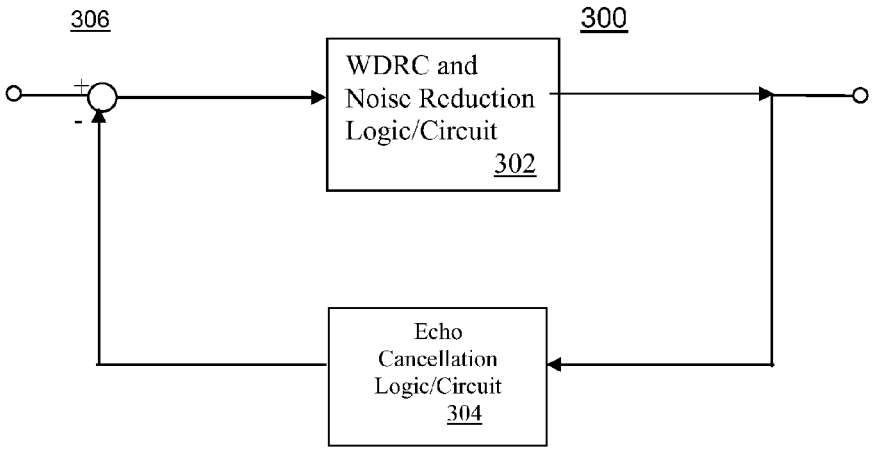
FIG. 3 is a block diagram of amplification logic according to one embodiment of the invention.

FIG. 3 is a block diagram of amplification logic 300 according to one embodiment of the invention. The amplification logic 300 is suitable for use as the amplification logic 204 illustrated in FIG. 2. The amplification logic 300 can include a first circuit/logic 302 to provide dynamic range compression and noise reduction. The dynamic range compression can, for example, be Wide Dynamic Range Compression (WDRC). The amplification logic 300 can also include a second logic/circuit 304 to provide echo cancellation. The second logic/circuit 304 is provided in a feedback loop and operates to produce a cancellation signal that is subtracted from an input signal at an adder 306.

Figure 4:
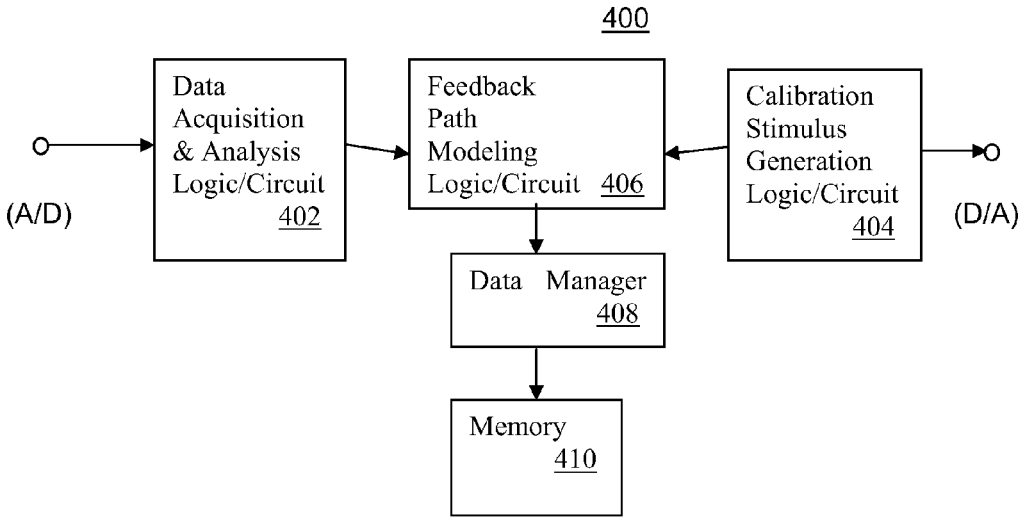
FIG. 4 is a block diagram of calibration logic according to one embodiment of the invention.

FIG. 4 is a block diagram of calibration logic 400 according to one embodiment of the invention. The calibration logic 400 is suitable for use as the calibration logic 206 illustrated in FIG. 2. The calibration logic 400 can implement a feedback calibration test. The calibration logic 300 can include data acquisition and analysis logic/circuit 402. The data acquisition and analysis logic/circuit 402 can couple to the A/D converter 104 illustrated in FIG. 2. When the digital hearing aid system 200 is operating in the calibration mode, calibration stimulus generation logic/circuit 404 generates a calibration stimulus. The calibration stimulus generation logic/circuit 404 can couple to the D/A converter 108 illustrated in FIG. 2 so that the calibration stimulus can be provided to the receiver 110. The calibration stimulus can also be provided to a feedback path modeling logic/circuit 406. The calibration stimulus can pertain to white noise or other noises whose characteristics can be easily described and used in deriving a transfer function of an unknown system. The sound produced by the receiver 110 may leak out from user's ear and be picked up by the microphone 102. The microphone signal is acquired and analyzed by the data acquisition and analysis logic/circuit 402 via the A/D converter 104. The feedback path modeling logic/circuit 406 produces a new model for the feedback path that is saved by a data manager 408 to memory 410.

After the data acquisition and analysis logic/circuit 402 has completed a feedback calibration test, the digital hearing aid system 200 can wait in the calibration mode for further action from the switch 208 or can automatically return to the normal amplification mode. In one embodiment, the digital hearing aid system 200 automatically returns to the normal amplification mode after calibration processing. In another embodiment, the digital hearing aid system 200 stays in the calibration mode and waits for further action from the switch 208. The further action from the switch 208 can, for example, include sending the digital hearing aid system 200 back to the normal amplification mode if the feedback calibration test succeeds or restart the calibration processing if the feedback calibration test fails. If the calibration processing continues to fail (e.g., fails on successive attempts), the digital hearing aid system 200 can be returned to the normal amplification mode.

In one embodiment, upon returning to the normal amplification mode after a successful calibration, the echo cancellation logic/circuit 304 uses the new model data of the feedback path to cancel any feedback echo more effectively. Hence, in this case, the digital hearing aid system 200 should not produce the undesirable whistling sound while in the normal amplification mode. On the other hand, upon returning to the normal amplification mode after a failed calibration, the echo cancellation logic/circuit 304 uses the existing model data since new modeling data has not been acquired. As a result, in such case, the digital hearing aid system 200 will continue to have a feedback problem.

Another aspect of the invention is an automated fitting procedure that can be performed without the need of a hearing aid professional. Using the automated fitting procedure a user can calibrate or recalibrate a digital hearing aid.

Figure 5:
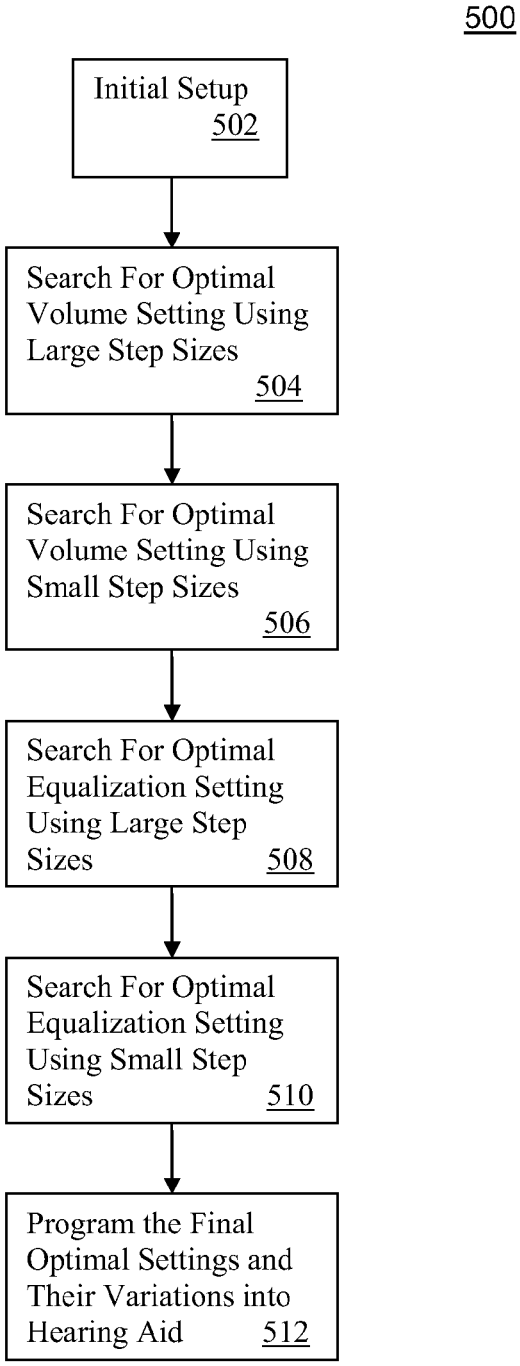
FIG. 5 is a flow diagram of an automated fitting procedure according to one aspect of the present invention.

FIG. 5 is a flow diagram of an automated fitting procedure 500 according to one aspect of the present invention. The automated fitting procedure 500 can be performed for a given user and his/her digital hearing aid system. The automated fitting procedure 500 can start with initial setup 502 of a digital hearing aid system. For example, initial setup 502 can include conducting ear environment calibration, calculating initial gain settings based on an audiogram, and/or starting playing of sound samples for the user.

Next, for the given user and his/her digital hearing aid system, optimal volume settings can be searched 504 for using large step sizes. The large step sizes make it possible for the search to converge fast. The resultant volume settings identified by the searching 504 are in the proximity of optimal values. However, for more accuracy, the optimal volume setting can be further searched 506 using small step sizes.

In addition, for the given user and his/her digital hearing aid system, optimal equalization settings can be searched 508 for using large step sizes. The large step sizes make it possible for the search to converge fast. The resultant equalization settings identified by the searching 508 are in the proximity of optimal values. However, for more accuracy, the optimal equalization settings can be further searched 510 using small step sizes.

Thereafter, the final optimal settings for volumes and equalization settings and their variations can be stored (e.g., programmed) into the digital hearing aid system. The variations can be simple modifications to the optimal settings, such as subtracting a constant from the optimal gain values to give hearing aids more margin for operational stability. Another example of the variations is to limit the settings within certain boundary conditions.

Figure 6:
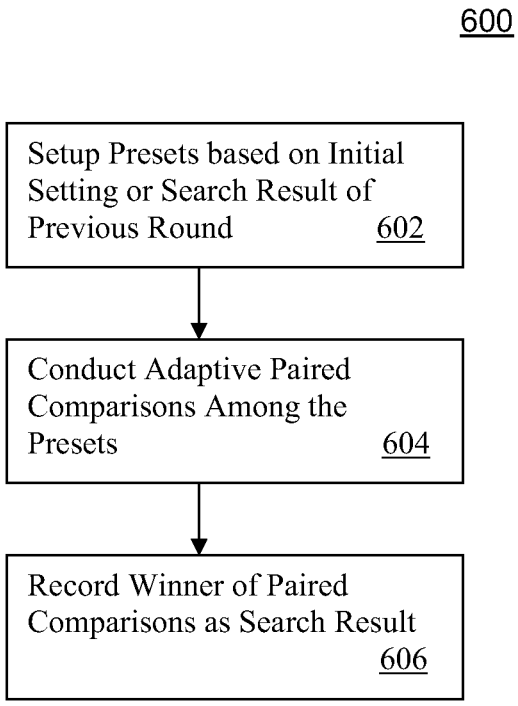
FIG. 6 is a flow diagram of a search process according to one embodiment of the invention.

FIG. 6 is a flow diagram of a search process 600 according to one embodiment of the invention. The search process 600 can be used by any of the searching performed by blocks 504-510 of the automated fitting procedure 500 illustrated in FIG. 5. The search process 600 can initially setup 602 presets based on the initial setting or the results of the prior search. Then, the search process 600 can conduct 604 an adaptive paired comparison among all presets until the best preset is found. The preset determined to be the best can then be recorded 606 as the winner of the search.

The automated fitting procedure 500 and the search process 600 can be repeated, completely or partially, under same sound environment or different sound environments. In one example, after going through the searches of blocks 504-510, the user can again go through the searches of blocks 506-510 with the same sound samples. In another example, after going through the searches of blocks 504-510, the user can again go through the searches of blocks 506-510 with different sound samples. By using different sound samples in this manner, the user is able to obtain separate settings for different listening conditions.

In one embodiment, the presets may be set up in a systematic way so that after patients compare any two presets, the search process 600 will know which pair should be presented to the user next. For example, for the searching at block 504 of the automated fitting procedure 500, if the presets can be set up as the followings:

A==Gain Settings calculated based audiogram (fitting algorithm)

B==A+5 dB

C==A+10 dB

D==A−5 dB

E==A−10 dB,

Then the search algorithm can, for example, be constructed as the following:

```
Compare (A, B)
    If A is preferred, Compare (A,D)
        If A is preferred, Stop. Winner is A
        If D is preferred, Compare (D, E)
            If D is preferred, Stop. Winner is D
            If E preferred, Stop. Winner is E
    Else If B is preferred, Compare (B, C)
        If B is preferred, Stop. Winner is B
    If C is preferred, Stop. Winner is C.
```

The searching performed by the search process 600 and the automated fitting procedure 500 can cover a relatively large range of gain settings but quickly converges to the optimal settings. The adaptive paired comparison procedure is easy for users to follow. Thus, the fitting procedure according to the present invention makes it possible for patients set up hearing aids themselves.

The various aspects, features, embodiments or implementations of the invention described above can be used alone or in various combinations.

The invention is preferably implemented by software, hardware, or a combination of hardware and software. The invention can also be embodied as computer readable code on a computer readable medium. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

The advantages of the invention are numerous. Different aspects, embodiments or implementations may, but need not, yield one or more of the following advantages. One advantage of the invention is that hearing aids are able to self-calibrate. By being able to self-calibrate, hearing aids are able to fix themselves when they need re-calibration. Another advantage of the invention is that a user (or other non-hearing specialist) can themselves perform a fitting process to fit a hearing aid to the user. Still another advantage of the invention is that users of hearing aids will not require as many visits to hearing professionals to maintain the effectiveness of their hearing aids.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An automated fitting procedure for a hearing aid device, comprising:

providing initial setup for the hearing aid device; the initial setup includes at least calculating initial settings from hearing loss data, performing an ear environment calibration, or playing sound samples in background;

searching for optimized volume settings using first predefined volume step sizes selected to provide convergence toward the optimized volume settings;

searching for optimized volume settings using second predefined volume step sizes selected to refine the optimal volume settings, the first predefined volume step sizes being larger than the second predefined volume step sizes;

searching for optimized equalization settings using first predefined equalization step sizes selected to provide convergence toward the optimized equalization settings;

searching for optimized equalization settings using second predefined equalization step sizes selected to refine the optimal equalization settings, the second predefined equalization step sizes being smaller than the first predefined equalization step sizes; and programming the hearing aid device for calibration and acoustic feedback cancellation in accordance with the optimized volume settings and the optimized equalization settings;

wherein said optimized volume settings and said optimized equalization settings each include at least a first, second, third, fourth, and fifth setting, respectively, and said searching for optimized volume settings and said searching for optimized equalization settings each comprises conducting adaptive paired comparisons, including:

comparing said first setting to said second setting;

if said first setting is preferred, comparing said first setting to said fourth setting;

if said first setting is still preferred, applying said first setting;

if said fourth setting is preferred instead, comparing said fourth setting to said fifth setting;

if said fourth setting is still preferred, applying said fourth setting; and if said fifth setting is preferred instead, applying said fifth setting.

2. A method as recited in claim 1, wherein said automated fitting procedure requires user interaction to initiate and to perform said searching for optimized volume settings and said searching for optimized equalization settings.

3. A method as recited in claim 1, wherein said automated fitting procedure requires no interaction by a hearing aid professional to perform said automated fitting procedure.

4. A method as recited in claim 1, wherein the hearing aid device is self-calibrated for an ear environment calibration.

5. A method as recited in claim 1, wherein the steps of searching for optimized volume settings and the steps of searching for optimized equalization settings comprise conducting adaptive paired comparisons in order to identify a best volume setting and a best equalization setting among all adaptive paired comparisons.

6. A digital hearing aid as recited in claim 1, wherein:

if said second setting is preferred instead over said first setting, comparing said second setting to said third setting;

if said second setting is still preferred, applying said second setting; and if said third setting is preferred instead, applying said third setting.

* * * * *